US005279885A

United States Patent [19]

Ohmori et al.

[11] Patent Number: 5,279,885

[45] Date of Patent: Jan. 18, 1994

[54] INK-JET RECORDING SHEET

[75] Inventors: Takashi Ohmori; Tadashi Yamagata; Atsushi Ono; Yutaka Kojima, all of Tokyo, Japan

[73] Assignee: Jujo Paper Co., Ltd., Tokyo, Japan

[21] Appl. No.: 820,252

[22] Filed: Jan. 14, 1992

[30] Foreign Application Priority Data

Jan. 18, 1991 [JP] Japan ..... 3-4333

[51] Int. Cl.[5] ..... B41M 5/00

[52] U.S. Cl. ..... 428/195; 428/35.7; 428/206; 428/292; 428/323; 428/341; 428/484

[58] Field of Search ..... 428/207, 195, 211, 411.1, 428/913, 35.7, 206, 292, 323, 341, 484

[56] References Cited

U.S. PATENT DOCUMENTS

| | | | |
|---|---|---|---|
| 4,636,409 | 1/1987 | Arai et al. | 428/206 |
| 4,680,235 | 7/1987 | Murakami et al. | 428/207 |
| 4,758,461 | 7/1988 | Akiya et al. | 428/195 |

*Primary Examiner*—Patrick J. Ryan
*Assistant Examiner*—William A. Krynski
*Attorney, Agent, or Firm*—Sherman and Shalloway

[57] ABSTRACT

This invention relates to a recording sheet for an ink jet printer comprising fibrous base material and a back-coating layer formed on the back surface of the base material, which characterized by that the base material contains a cationic polymer size (a), and the back-coating layer comprises a pigment, a binder and two or more of sizes (b1) and (b2), said size (b1) being alkyl ketene dimer, alkenyl succinic anhydride, or wax emulsion, and said size (b2) being a cationic polymer.

11 Claims, No Drawings

INK-JET RECORDING SHEET

FIELD OF THE INVENTION

This invention relates to a recording sheet for an ink jet printer.

DESCRIPTION OF THE PRIOR ART

In recent years, a substantial demand for a color printer has developed. More particularly, an ink jet recording system, one of the non-impact recording systems, has been highly evaluated because a high-speed color recording is possible without complicated devices. There are, however, many problems which must be overcome to get a very fine full-color image by an ink jet recording system.

Two types of recording papers, a plain-type and a coated-type, are generally available for ink jet recording. In a plain-type paper, ink is absorbed into empty pores formed among fibrous materials or among fibrous materials and fillers while, in a coated-type paper, ink is absorbed into empty pores formed in a coated layer comprising fillers and a binder on paper backing. Although the coated-type paper has an excellent resolving power due to smaller and circular ink dots, it is unsuitable for high speed full-color recording system since both absorption rate and absorbency are too low to absorb a large amount of ink used for full-color recording in a short time. Moreover, its cost is higher than a plain-type paper.

As high-speed printers are widely used, demands for a plain-type recording paper are increasing because of its lower cost than a coated paper, its excellent paper-like touch and appearance, and its high ink absorption rate.

Well known processes for producing a plain-type paper for ink jet recording are described below.

One process is a coating process as illustrated in Japanese Laid Open No. Sho 53-49113 and Japanese Laid Open No. Sho 58-8685, which comprises coating a surface of a nonsized paper manufactured by adding synthetic resin powder or pulverized synthetic silicates with a water-soluble polymer. The recording sheet of this type, comprising only an ink receptive layer, has an improved ink absorbency adaptable to a high speed printer, however; it has an inferior resolving power due to blotted, feathered ink dots when used for a fall-color printer wherein a large amount of ink is used. Moreover, the ink penetrates deep into the direction of the thickness, which causes print through and a decrease of recording density caused by the light scattering of an upper layer of the recording sheet. In this specification, the term 'print through' indicates 'show through' or 'strike through'. The term 'show through' means a condition wherein an outline of the printed figure on the recording sheet is clearly observed when seeing it from the back surface of the recording sheet, and the term 'strike through' means a condition wherein the ink goes through the recording sheet like pinholes.

Another technique for a plain-type ink jet paper is to add or to coat a sizing agent in order to control the absorbency of water soluble ink. Japanese Laid Open No. Sho 56-109783 discloses adding a sizing agent, and Japanese Laid Open No. Sho 60-27588 and Japanese Laid Open No. Sho 61-50795 disclose coating a sizing agent. Examples of sizing agents are fortified rosin sizing agent, petroleum resin sizing agent, emulsion type rosin sizing agent, alkenyl succinic acid type synthetic sizing agent, reactive sizing agent such as alkyl ketene dimer (AKD) and alkenyl succinic acid anhydride (ASA), wax emulsion sizing agent, and self-fixing type cationic polymer size.

If a sufficient amount of size to prevent print through is used, blotting or feathering occurs because ink is not absorbed well on the surface of the recording sheet. On the other hand, if a small amount of size is used, a large amount of ink is absorbed; however, show through or strike through eventually occurs. Although a suitable amount of sizing agent provides an improved ink absorbency suitable for a full-color recording system wherein a large amount of ink is used, it migrates as the time proceeds to cause a change of ink absorbency leading to low printing quality.

Japanese Laid Open No. Sho 63-118287 discloses an uncoated, two-layered ink jet recording sheet comprising a pulp fiber backing sheet (the first layer) and a filler-containing-pulp fiber sheet (the second layer). The recording density can be improved by the addition of fillers; however, the above sheet is unsuitable for a full-color recording system in which a large amount of water-soluble ink is used because the ink penetrates into the untreated first layer so heavily that show through or strike through cannot be avoided.

Japanese Patent Laid Open No. Sho 64-78877, Japanese Patent Laid Open No. Hei 2-243381, and Japanese Laid Open No. Hei 2-243382 disclose processes for producing a sheet combining more than two fibrous layers having different functions- an ink-absorbing layer and an anti-ink-penetration layer to improve printing properties and print through. The above processes, however, are very unusual as a process for the production of printing papers. The above methods are hardly applicable to the production of business communication paper of low basis weight, because the productivity is low and there are many technical difficulties to be solved. As described above, it has been very difficult to produce a recording sheet having improved strike- or show-through and constant ink absorbency while holding excellent printing characteristics and ink absorbency.

SUMMARY OF THE INVENTION

It is an object of this invention to provide a plaintype ink jet recording sheet having a homogeneous image quality, a high recording density, a sufficient ink absorbency suitable for a full- color recording system, little print through, a stable ink absorbency after storage, and a high productivity.

DETAILED DESCRIPTION OF PREFERRED EMBODIMENTS

The inventors of this invention thought that if a blot in the transverse direction and the deep penetration of ink in the direction of the thickness could be prevented when a drop of ink reached the recording surface of fibrous backing sheet, the ink would stay around the surface of the recording layer, thus a plain-type ink jet recording sheet having a high recording density and little strike- and show-through would be obtained.

The inventors discussed the use of sizing agents to control an ink absorbency and print through. It is well known that a neutral sized paper is suitable for an ink jet recording sheet since it provides a good color development and a good recording image having little tone-change. Examples of neutral sizes are alkyl ketene dimer (AKD), alkenyl succinic acid anhydride (ASA) size, and nonionic or cationic wax emulsion size. Thus the inventors discussed these neutral sizes and found that wide blot and deep penetration of ink could be prevented by adding these sizes into neutral base paper or coating the recording surface with a suitable amount of these neutral sizes. As most of the ink stays around the recording surface, a plain-type recording sheet having a high recording density, little print through, and a high productivity was obtained.

However, as P. Rohringer et al. showed in Jappi J (Vol. 68, No. 1, p 83–86), it is known that when AKD is used, the increase of the sizing effect at paper manufacturing is not good and that sizing effect changes as the time proceeds. Moreover, AKD migrates easily. Other neutral sizing agents such as ASA and wax emulsion sizing agent, added or coated, give a fast rising however, they also cause migration. The migration of sizing agent is a serious disadvantage for an ink jet recording sheet wherein a constant ink absorbency at a recording layer after storage is required to get correct information.

The inventors of the present application discovered that optical print-through can be prevented by using a recording sheet having an opacity of 75% or more, measured under the specific thickness defined in Japanese Patent Laid Open No. Sho 64-78877, according to JIS P8138. If the opacity is 75% or more, the show through decreases even though ink penetrates deeply. However, when a sufficient amount of sizing agent to prevent print through is used at full-color recording wherein a large amount of ink is used, ink absorbency begins to decrease.

The inventors of the present application added a cationic polymer sizing agent (a) into a fibrous base material, and coated the back surface of the above-mentioned base material with a coating composition comprising a pigment, a binder and two or more of sizing agent (b1) and (b2), wherein (b1) being one or more of alkyl ketene dimer (AKD), alkenyl succinic acid anhydride (ASA), or wax emulsion sizing agent, and (b2) being a cationic polymer size.

The fibrous base material used in this invention comprises pulp such as wood pulp, cotton pulp, and regenerated pulp from used paper, but inorganic fiber such as glass fiber, synthetic fiber and synthetic pulp may also be used if necessary.

Other additives such as fillers, retention aids, wet-strength agents, fixing agents, dispersing agents, and water-proof agents for water-soluble dye may be added into the above fibrous material if necessary.

A sizing agent or size added into the fibrous base material according to the present invention is a cationic polymer size (a). The addition of other sizes ordinary used for fibrous base material such as fortified rosin size, petroleum resin size, emulsion-type rosin size, alkenyl-succinic-acid-type synthetic size, wax emulsion size, and reactive size e.g. alkyl ketene dimer (AKD) or alkenyl succinic acid anhydride (ASA), gives insufficient ink absorption control, ink fixation, and ink absorbency after storage.

The preferable amount of size (a) used in the present invention is from 0.1 to 1 percent by weight based on pulp. If an excess amount of size (a) is used, the ink absorbency decreases, and if an insufficient amount of size (a) is used, a back coating composition penetrates deep into base material thus, the control of ink absorbency at a recording layer is difficult and the prevention of print through is impossible. The typical types of the following cationic polymer sizes (a) are used in the present invention. (M.Usuda, J.Tappi vol36 No.1 p100–108, 1982)

1. Resin type

COMPOUND 1 maleic-acid-modified petroleum resin/ polyalkylene polyamine/ quaternary salt

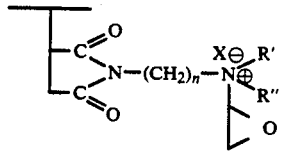

COMPOUND 2 rosin/higher fatty acid/polyalkylene polyamine/ quaternary salt

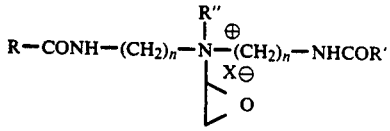

2. Polymer type

COMPOUND 3 hydrophobic monomer/cationic monomer copolymer/ quaternary salt

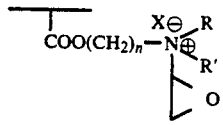

COMPOUND 4 hydrophobic monomer/maleic anhydride derivatives copolymer/ polyalkylene polyamine/ quaternary salt

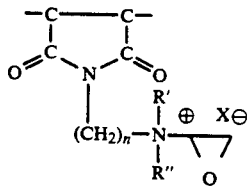

R, R' and R'' are alkyl groups which may have different substitutes.

Examples of fillers added into fibrous base material are calcium carbonate, clay, kaolin, terra abla, talc, synthetic silica, alumina, aluminum hydroxide, zinc oxide, calcium silicate, synthetic silicate, titanium oxide, diatomaceous earth, barium sulfate, satin white, magnesium carbonate, and organic resin pigment. It is important to choose fillers useful to increase ink absorbency and to decrease scattered light reflection. Fillers are not always used in order to increase recording density of the base material. However, in order to increase ink absorbency and to obtain a clear image of high density and resolving power by the control of the form and/or extension of ink dots, fillers such as medium-sized heavy calcium carbonate etc. are preferably used.

Various additives other than fillers may be added into fibrous base material to improve the quality of printed figures, workability, yield, and water resistance of printed images. Examples of such additives are starch, cation modified starch, polyvinyl alcohol, cellulose derivatives such as hydroxyethyl cellulose and carboxymethyl cellulose, polyacrylamide, polyamide epichlorohydrin resin, polyvinyl pyridine, polyethylene oxide, polyvinyl pyrrolidone, casein, gelatin, sodium alginate, sodium salt of polystyrene sulfonic acid, sodium salt of polyacrylic acid, the hydrolysis product of starch-acrylonitrile graftpolymer, sulfonated chitin, carboxymethyl chitin, chitosan and its derivatives, polyethyleneimine, polydimethyl diallyl ammonium chrolide, polyalkylene polyamine dicyandiamide ammonium condensate, polyvinyl pyridium halide, quaternary ammonium salt of alkyl(meth)acrylate, and quaternary ammonium salt of (meth)acrylamide. The cationic polymer is used as a water-proofing agent for images; polyacrylamide and cationic starch are used as retention aids; polyamide epichlorohydrin resin is used as a wet-strength agent or as an anti-cockling agent.

Cockling, caused by a large amount of ink absorbed in a recording sheet, is one of the problems in the full-color ink jet recording system. Cockling can be prevented by the addition of the additives described above as well as the use of fibrous base material manufactured by the Yankee paper machine to prevent elongation at wet. Thus, fibrous base material used in the present invention desirably has an elongation when wet of 3.0% or less, more preferably 2.0% or less, determined (J. TAPPI 27-78 expansion test for paper and paper board) after the material is soaked in the water for 300 seconds.

A back coating layer formed on the opposite surface of the recording surface usually prevents print through. The coating composition comprises a pigment, a binder, sizes (b1) and (b2) and various additives if necessary.

The present invention proposes the use of two or more kinds of sizes, (b1) and (b2), for the back coating composition to control print through and the ink absorbency.

Preferable sizes (b1) are neutral sizes such as AKD, ASA, and wax emulsion size. The characteristics of the sizes (b1) are that they can fully prevent strike-through because of their excellent water resistant properties. However, if only size (b1) is used to coat the back surface, the size (b1) migrates from the coating layer to the fibrous base layer when it is heated or as time proceeds, causing decreased ink absorbency.

The size (b2) is a cationic polymer. It belongs to the same category as the size (a) added into fibrous base material. The size (b2) may be the same compound as the size (a) or may be a different compound from the size (a).

When an increased amount of size (b2) is used, print through can totally be prevented. Although the single use of size (b2) can prevent show through to some extent, it cannot prevent pinhole-like strike through.

One of the features of the present invention is to use sizes (b1) and (b2) at the same time. The inventors of the present invention have found that shortcomings caused by the separate use of the size (b1) or (b2) may be offset by using sizes (b1) and (b2) together. A suitable solid amount of sizes (b1) and (b2) is 5 to 40 percent by weight, preferably 10 to 30 percent by weight, based on a coating composition. The ratio of size (b1) to (b2) is in the range from 1/10 to 10/10, more preferably from 2/10 to 7/10.

Pigments used in a coating composition include calcium carbonate, clay, kaolin, terra alba, talc, synthetic silica, alumina, aluminum hydroxide, zinc oxide, calcium silicate, synthetic silicate, titanium oxide, diatomaceous earth, barium sulfate, satin white, magnesium carbonate, and organic resin pigments. These pigments contribute to increased hiding power. Considering the paper feeding at a printer, pigments such as titanium oxide, calcium carbonate, kaolin, talc and titanium oxide-treated-silica are preferably used alone or used together.

Binders used in the coating composition include starch, water-soluble resins such as polyvinyl alcohol, and filmforming emulsions such as SBR latex, ethylene-vinyl acetate copolymer latex and acrylic resin latex.

Other additives used in the coating composition are a dispersing agent, a viscosity-controlling-agent, a lubricant, a levelling agent, and an anti-foaming agent.

The inventors of the present invention have discussed how could they know the ink absorbing rate and the ink absorbing capacity of recording sheets used for the fullcolor recording system, and have found that the amount of ink absorbed in the recording sheet after the sheet is contacted with a liquid (ink) for 0.05 seconds can be a good indicator of the actual ink absorbing rate and capacity. The amount of ink is measured by a dynamic liquid sorption tester according to a testing method described in J. TAPPI 51-87 (Bristow's method). In this test, a black ink having a composition shown below is used as a liquid.

| | |
|---|---|
| C.I. Foodblack 2 | 4 parts |
| diethylene glycol | 15 parts |
| polyethylene glycol | 15 parts |
| water | 66 parts |

The above ink is a normalized, stable, and repeatable ink. The ink absorbency including ink absorbing rate and capacity can be judged by measuring an amount of ink transferred to the recording sheet after the sheet is contacted with the ink for a very short time. If the sheet has a Bristow transfer of 10 ml/m$^2$ or less, it shows that the ink absorbing rate and the ink absorbency are not good. Thus, the run or flow of ink may occur if such a sheet is used for some printers wherein the amount of ink is so much that the ink is not absorbed in the recording layer. On the contrary, if the sheet has a Bristow transfer of 70 ml/m$^2$ or more, it shows that the ink penetrates deep into the recording layer so that print through occurs. Thus, a recording density and a clearness of the recording image are reduced as a result of the decrease of ink remaining around the surface of the recording layer.

In order to prevent the deep penetration of coating composition into fibrous base material, which prevents the absorption of ink from the side of the recording surface, the viscosity of coating composition is preferably controlled in the range about from 5 to 2000 cps. The amount of coating composition and the ingredients should be controlled so that the surface of fibrous base material has the Bristow transfer of from 10 ml/m$^2$ to 70 ml/m$^2$. It is preferable to use at least 2 to 20 g/m$^2$, more preferably 3 to 15 g/m$^2$, of coating composition to prevent print through and to increase hiding power.

In order to obtain a more clear and dense recording image, a fine coating layer comprising a fine filler and a binder may be provided on the front surface of recording layer in the amount of from 1 to 9 g/m$^2$. Porous fillers having 20 to 0.1 μm of average particle size are preferable. The fillers include synthetic silica, magnesium silicate, alumina, aluminum hydroxide, silicate salts, and basic magnesium carbonate.

Any coating machine, for example, a size press, roll coater, air knife coater, blade coater, bar coater, curtain coater, or spray coater, may be used to apply coating compositions to the back surface of base material and to the front surface of the recording layer.

According to the present invention, a recording sheet having excellent full-color ink jet recording characteristics, no print through, constant and stable ink absorbency, and an excellent productivity can be obtained by coating the back surface of fibrous base material with a coating composition comprising a pigment, a binder and two or more kinds of sizes (b1) and (b2), wherein the base material contains a cationic polymer size (a), the size (b1) being AKD, ASA, and/or wax emulsion size, and the size (b2) being a cationic polymer. While the exact reason why an excellent recording sheet is obtained has not been precisely determined, it is believed that sizes (a), (b1) and (b2) work together to overcome the disadvantages of each size as described below.

According to this invention, ink absorbency is controlled by a size added into fibrous base material, and print through is prevented by a back coating layer comprising a pigment and two or more kinds of sizes. In the fullcolor ink jet recording system wherein two or three color inks are piled up to develop color, a large amount of ink is used. Accordingly, the ink absorbency must be controlled by the addition of a small amount of size (a). Additionally, the ink absorbency must be kept constant and stable in order to get homogeneous full-color recording images. According to the present invention, total print through can be prevented by coating the back surface of fibrous base material with a coating composition comprising a pigment and sizes (b1) and (b2). The pigment used in the back coating layer mainly prevents optical print through, the size (b1) prevents strike through, and the size (b2) control the ink absorbency but cannot completely prevent pinhole-like strike through. As previously disclosed, the single use of size (b1) cannot prevent the migration of size (b1) itself from the back coating layer to the fibrous base material even if the size (a) is added in the fibrous base material. Similarly, the single use of size (b2) cannot completely prevent print through. It is believed that when a specific amount of (b1) and (b2) are used as a coating material, very permeable, polymer surface active agent (b2) having a hydrophobic part and a hydrophilic cation in a molecule, penetrates into the fibrous base material faster than the (b1) to bond to the negatively charged surface of the base material through it's cationic part. It is also believed that the migration which occurs during the drying process or as the time proceeds can be prevented by the affinity of hydrophobic size (b1) and the hydrophobic part of size (b2). In an ink jet process, the recording sheet of the invention records information with an ink jet ink, preferably containing from 10 to 50% of water soluble organic solvent.

According to the present invention, a plain-type-like recording sheet having a high printing density, an excellent ink absorbency which does not change as the time proceeds, and a sufficient resistance to print through is obtained. Additionally, as the back coating layer is formed by using normally used coating machines, the productivity is very high.

EXAMPLES

The following examples will more clearly illustrate the preferred embodiments of the invention. All parts and % are by weight solid unless otherwise indicated.

EXAMPLE 1

A fibrous base sheet having a base weight of 70 g/m$^2$ was manufactured by adding 10 parts of ground calcium carbonate filler (Calcite structure, amorphous, 50% average particle size: 4.6 μm, BET specific surface area: 3.4 m$^2$/g), 0.5 parts of size (a)—quaternary ammonium salt of polystyrene acrylic acid ester size J, 0.3 parts of polyamide epichlorohydrin resin as a wet-strength agent, and 0.01 parts of cation modified polyacrylamide (viscosity of 50% concentration: 590 cps) as a retention aid into 100 parts of LBKP pulp (freeness 400 ml), mixing and stirring the above mixture, making paper by a hand-manufacture test machine (TOZAISEIKI Co.), dehydrating and finally stretch drying thus manufactured sheet to prevent shrinkage caused by drying process. The elongation of the fibrous base sheet measured according to J.TAPPI 27-78 (expansion test for paper and paper board), after it was soaked in the water for 300 seconds, was 1.7%.

A coating composition for back coating was prepared according to the processes disclosed below. First, a filler slurry was prepared by mixing and dispersing 30 parts of titanium oxide (anatase structure, specific gravity: 3.9, 50% average particle size: 0.3 μm), 50 parts of kaolin, and 20 parts of light calcium carbonate (calcite structure). To this slurry, 15 parts of SBR latex, 15 parts of oxidized starch, 8 parts of size (b1)-alkyl ketene dimer size K (cationic, pH 3.0, viscosity: 30 cps), and 20 parts of size (b2)-quaternary ammonium salt of polystyrene acrylic acid ester size J were added, and finally water was added to prepare a back coating composition having 25% solid concentration. Then the composition was applied to the back surface of the fibrous base material with a Mayer bar in a solid amount of 8 g/m$^2$, dried, and finally calendared to produce an ink jet recording sheet of this invention.

EXAMPLES 2-3

An ink jet recording sheet of Example 2 was prepared in a manner as described in Example 1, except that 5 parts of 10% emulsion of size L, the 2:1 mixture of cationic starch and alkenyl succinic acid anhydride (cationic, viscosity: 200 cps), was used as size (b1).

Similarly, an ink jet recording sheet of Example 3 was prepared in a manner as described in Example 1, except that 5 parts of wax emulsion size M (pH: 8.5-9.5, viscosity: 100-300 cps), emulsified with a nonionic surface active agent, was used as size (b1).

COMPARATIVE EXAMPLES 1-2

Ink jet recording sheets were prepared in a manner as described in Example 1, except that only one kind of size was used as the sizes for the back coating composition. In Comparative Example 1, 28 parts of alkyl ketene dimer size K (cationic, pH: 3.0, viscosity: 30 cps), and in Comparative Example 2, 28 parts of quaternary ammonium salt of polystyrene acrylic acid ester size J were used respectively.

COMPARATIVE EXAMPLES 3-6

An ink jet recording sheet by Comparative Example 3 was prepared in a manner as described in Example 1, except that 0.5 parts of alkyl ketene dimer size K (cationic, pH: 3.0, viscosity: 30 cps) was used as size (a) instead of 0.5 parts of quaternary ammonium salt of polystyrene acrylic acid ester size J.

Three kinds of fibrous base materials were prepared in a manner as described in Example 1, except that 0.1 parts, 0.5 parts and 2.5 parts of quaternary ammonium salts of polystyrene acrylic acid ester size J were used respectively instead of 0.5 parts of size J, and that the back coating treatment was omitted. Thus, ink jet recording sheets of Comparative Examples 4–6 were prepared.

EXAMPLE 4

Fibrous base material was prepared in a manner as described in Example 1. Then a filler slurry for a back coating composition was prepared by mixing 50 parts of kaolin, 50 parts of titanium oxide-silica complex (oil absorption: 220 mg/100 g, BET specific surface area: 91 $m^2/g$, average particle size: 4.7 μm, $TiO_2/SiO_2$: 16/100), a dispersing agent and water. To this slurry, 15 parts of polyvinyl alcohol, 15 parts of oxidized starch, 10 parts of alkyl ketene dimer size K (cationic, pH: 3.0, viscosity: 30 cps) as size (b1), 14.3 parts of quaternary ammonium salt of polystyrene acrylic acid ester size J as size (b2) and water were added to prepare a back-coating composition having 25% solid concentration. The back-coating composition thus prepared was applied by a Mayer bar to the back surface of the fibrous base material in the solid amount of 5 $g/m^2$. Finally, the sheet thus coated was dried, and calendared to produce an ink jet recording sheet of Example 4.

EXAMPLE 5

A recording sheet having improved printing properties was prepared by the following procedures. First, 100 parts of pulverized silica (50% average particle diameter: 2.7 μm, BET specific surface area: 270 $m^2/g$, produced by the wet precipitation process) was dispersed into water, and to this dispersion, 20 parts of polyvinyl alcohol (saponification rate: 99%, average degree of polymerization: 1700), 5 parts of polydimethyldiallyl quaternary ammonium salt (average molecular weight: 120000), and water were added to prepare a coating composition having 16% solid concentration. The coating composition was applied by a Mayer bar to the front surface of recording sheet prepared in Example 1 in a solid amount of 8 $g/m^2$, and the sheet thus prepared was calendared in a manner as described in Example 1 to prepare an ink jet recording sheet of Example 5 having coating layers on both front and back surfaces of the fibrous base material.

The properties of ink jet recording sheets produced by the above Examples and Comparative Examples were tested and evaluated according to the methods disclosed below. The results are shown in Table 1.

1. Recording Density

Four-color-solid prints (1.5 cm×2 cm; black, cyan, magenta, and yellow) were obtained by using a Cannon Color Printer BJC 430, and the recording density of recording parts was measured by a Mcbeth RD 915 (Kollmorgen Corporation) densitomer. In Table 1, the sums of each recording density obtained for four colors were shown. The total density of 3.3 or more was evaluated as good.

2. Print Through

Solid prints gotten by piling up three color inks (cyan, magenta, and yellow) were obtained by using a Cannon Color Printer BJC 430. On visual examination of the back surface of recording parts, strike-through and show-through were evaluated.

Evaluation A—no strike through and little show through

Evaluation B—no strike through but a little show through

Evaluation C—little strike through but heavy show through or heavy strike through but little show through Evaluation D—strike through and heavy show through 3. Bristow Transition (ink absorbency)

The amount of liquid (the normal black ink described previously) absorbed on the surface of recording sheet after the sheet was contacted with the liquid for 0.05 seconds was measured according to the Bristow's method (J.TAPPI 51-87 Dynamic Liquid Sorption Test for Paper and Paper Board).

4. Blot

A series of solid prints (1.5 cm×2 cm) of red, green and purple, continuously printed in this order, was obtained by piling up two of three color inks (cyan, magenta, and yellow) by a Cannon Color Printer BJC 430, and the degree of adjacent ink flow, running from one side to the other or running to mutual sides, was evaluated.

Evaluation A—no blot and flow

Evaluation B—little blot and flow

Evaluation C—heavy blot and flow

5. Storage Stability

After the recording sheets of Examples 1–5 and Comparative Examples 1–6 were stored for two weeks at normal room temperature and humidity, the Bristow transfer and blot were measured.

TABLE 1

| Examples | E1 | E2 | E3 | E4 | E5 | C1 | C2 | C3 | C4 | C5 | C6 |
|---|---|---|---|---|---|---|---|---|---|---|---|
| Size (a) | J | J | J | J | J | J | J | K | J | J | J |
| Parts | | | | | | | | | 0.1 | 0.5 | 2.5 |
| Size (b1/b2) | K/J | L/J | M/J | K/J | K/J | K | J | K/J | — | — | — |
| Recording Density | 4.39 | 4.33 | 4.28 | 4.01 | 5.21 | 4.39 | 4.33 | 4.46 | 3.95 | 4.38 | 3.28 |
| Print Through | A | A | A | A | A | A | C | A | D | C | A |
| Bristow Transfer | 35 | 31 | 28 | 23 | 38 | 35 | 35 | 21 | 78 | 36 | 5 |
| Bristow Transfer after 2 wks Storage | 31 | 28 | 27 | 20 | 32 | 8 | 34 | 5 | 75 | 37 | 6 |
| Blot | A | A | A | A | A | A | A | B | A | A | C |
| Blot after 2 wks Storage | A | A | A | A | A | C | A | C | A | A | C |

The data in Table 1 (Examples 1–5, Comparative Examples 1–6), clearly shows that ink jet recording sheets have an excellent resistance to show through or strike through, and a constant ink absorbency after storage is obtained by adding a cationic polymer size (a) into fibrous base material, and coating the back surface of base material with a coating composition comprising a specific ratio of sizes (b1) and (b2). Although the data was not shown in Table 1, the recording sheets of Examples 1–5 have little cockling.

When Examples 1 and 4 are compared with Comparative Example 1, it will be understood that the Bristow transfer of Comparative Example 1 wherein no (b2) size is used, decreases greatly after two-week-storage, and that the ink absorbency decreases as a relative amount of size (b1) in the coating composition increases. Additionally, Example 5 shows that printing density is greatly improved by coating the front surface of a recording sheet with a coating composition comprising pulverized fine powder.

In accordance with the present invention, a plain-type-like ink jet recording sheet having excellent properties as disclosed previously is proposed. The sheet comprises a fibrous base material which contains a cationic polymer size (a), and a back coating layer comprising a pigment, a binder, and two or more kinds of sizes (b1) and (b2) on the back surface of fibrous base material. The size (b1) is alkyl ketene dimer, alkenyl succinic anhydride, or wax emulsion size, and the size (b2) is a cationic polymer size. The recording sheet of this invention, manufactured in a high productivity, has a homogenous image quality, a high recording density, an excellent ink absorbency suitable for full-color recording, and little show through or strike through. Moreover, the ink absorbency of this sheet does not decrease after storage.

Additionally, the back-coating layer slightly prevents the cockling of recording sheet caused by swelling and shrinking of fibrous material as a result of absorption of large amount of ink. Moreover, it contributes to improved recording properties such as recording density. Further, if the front surface of recording sheet is coated with a coating composition comprising fine fillers as described previously, a recording sheet equal to a commercially available, heavy-coat-type ink jet recording sheet, coated with a large amount of fillers having a high ink absorbency, is obtained.

We claim:

1. A recording sheet suitable for an ink jet printer comprising:

a fibrous base material, said base material having a cationic polymeric sizing agent (a) added thereto; and a back coating layer on the back surface of the base material, said back coating layer comprising a pigment, a binder and at least two different kinds of sizes (b1) and (b2), wherein said size (b1) is a neutral size, and said size (b2) is a cationic polymer which may be the same or different as the cationic polymer (a) in the base material, and wherein a front recording surface of said recording sheet has a Bristow transfer of from 10 to 70 ml/m$^2$ after a 0.05 second contact, determined according to the method for determining liquid absorbability of paper and paper board described in J. TAPPI 51-87.

2. The recording sheet according to claim 1, wherein the front surface of the recording surface is coated with a front coating composition comprising a water soluble polymer.

3. The recording sheet of claim 2, wherein said front coating composition further comprises a filler having an average particle diameter of 20 to 0.1 μm, in a coating amount of 1 to 9 g/m$^2$.

4. The recording sheet according to claim 2, wherein the fibrous base material after soaking in water for 300 seconds has an elongation when wet of no greater than 3%, determined according to a method for determining of expansion of paper when dipping in water described in J. TAPPI 27-28.

5. The recording sheet according to claim 1, wherein the fibrous base material after soaking in water for 300 seconds has an elongation when wet of no greater than 3%, determined according to a method for determining of expansion of paper when dipping in water described in J. TAPPI 27-28.

6. The recording sheet of claim 1, wherein said neutral size (b1) is selected from the group consisting of alkyl ketene dimer, alkenyl succinic anhydride, and wax emulsion.

7. A recording sheet suitable for an ink jet printer comprising:

a fibrous base material, said base material having a cationic polymeric sizing agent (a) added thereto; and a back coating layer on the back surface of the base material, said back coating layer comprising a pigment, a binder and at least two different kinds of sizes (b1) and (b2), wherein said size (b1) is a neutral size, and said size (b2) is a cationic polymer which may be the same or different as the cationic polymer (a) in the base material, and wherein said fibrous base material after soaking in water for 300 seconds has an elongation when wet of no greater than 3%, according to a method for determining of expansion of paper when dipping in water described in J. TAPPI 27-28.

8. A recording sheet capable of recording information from an ink jet using ink jet ink containing from 10% to 50% of water soluble organic solvent comprising:

a fibrous base material, said base material having from 0.1 to 1 percent by weight of a cationic polymeric sizing agent (a) added thereto; and a back coating layer on the back surface of the base material, said back coating layer comprising a pigment, a binder and at least two different kinds of sizes (b1) and (b2), wherein said size (b1) is a neutral size, and said size (b2) is a cationic polymer which may be the same or different as the cationic polymer (a) in the base material.

9. A recording sheet suitable for an ink jet printer comprising:

a fibrous base material, said base material having a cationic polymeric sizing agent (a) added thereto; and a back coating layer on the back surface of the base material, said back coating layer comprising a pigment, a binder and at least two different kinds of sizes (b1) and (b2), wherein said size (b1) is a neutral size selected from the group consisting of alkyl ketene dimer, alkenyl succinic anhydride, and wax emulsion, and said size (b2) is a cationic polymer which may be the same or different as the cationic polymer (a) in the base material.

10. A recording sheet suitable for an ink jet printer comprising:

a fibrous base material, said base material having a cationic polymeric sizing agent (a) added thereto; and a back coating layer on the back surface of the base material, said back coating layer comprising a pigment, a binder and at least two different kinds of sizes (b1) and (b2), wherein said size (b1) is a neutral size, said size (b2) is a cationic polymer which may be the same or different as the cationic polymer (a) in the base material, and from 1 to 9 g/m$^2$ of a front coating composition on the front surface of the base material, said front coating composition comprising a water soluble polymer and a filler having an average particle diameter of 20 to 0.1 μm.

11. A recording sheet suitable for an ink jet printer comprising:

a fibrous base material, said base material having a cationic polymeric sizing agent (a) added thereto; and a back coating layer on the back surface of the base material, said back coating layer comprising a pigment, a binder and at least two different kinds of sizes (b1) and (b2), wherein said size (b1) is a neutral size, said size (b2) is a cationic polymer which may be the same or different as the cationic polymer (a) in the base material, a front coating composition on the front surface of the base material, said front coating composition comprising a water soluble polymer, said fibrous base material after soaking in water for 300 seconds having an elongation of no greater than 3%, determined according to a method for determining expansion of paper when dipping in water described in J. TAPPI 27-28.

* * * * *